US005737176A

United States Patent [19]

Muz

[11] Patent Number: 5,737,176

[45] Date of Patent: Apr. 7, 1998

[54] DEVICE FOR NEUTRALIZING ELECTROSTATIC CHARGES

[75] Inventor: Edwin Muz, Reutlingen, Germany

[73] Assignee: Haug GmbH & Co. KG, Leinfelden-Echterdingen, Germany

[21] Appl. No.: 783,990

[22] Filed: Jan. 15, 1997

[30] Foreign Application Priority Data

Jan. 25, 1996 [DE] Germany ..... 196 02 510.9

[51] Int. Cl.[6] ..... H01T 19/04

[52] U.S. Cl. ..... 361/220; 361/213; 361/229

[58] Field of Search ..... 361/212, 213, 361/214, 220, 221, 222, 225, 229, 230; 250/324–326; 399/168–173

[56] References Cited

U.S. PATENT DOCUMENTS

| | | | |
|---|---|---|---|
| 2,866,923 | 12/1958 | Herbert . | |
| 3,551,743 | 12/1970 | Koepke et al. | 361/230 |
| 3,652,897 | 3/1972 | Iosue et al. | 361/230 |
| 3,769,695 | 11/1973 | Price et al. | 361/213 |
| 3,968,405 | 7/1976 | Testone | 361/220 |
| 4,216,518 | 8/1980 | Simons | 361/213 |
| 4,263,636 | 4/1981 | Testone | 361/230 |

FOREIGN PATENT DOCUMENTS

| | | |
|---|---|---|
| 21 44 948 | 3/1972 | Germany . |
| 29 30 902 | 2/1980 | Germany . |
| 31 06 187 | 9/1982 | Germany . |

*Primary Examiner*—Fritz Fleming
*Attorney, Agent, or Firm*—Barry R. Lipsitz

[57] ABSTRACT

A device for neutralizing electrostatic charges by way of corona discharge comprises discharge electrodes and earthed counterelectrodes, the discharge electrodes being capacitively connected to an alternating high-voltage source. A row of individual discharge electrodes is applied to one side of a carrier consisting of dielectric material galvanically separated from one another in the form of thin, electrically conductive layers. A continuous, electrically conductive coating is arranged on the other side of the carrier and opposite to the discharge electrodes, this coating being connected to the high-voltage source and providing a capacitive coupling of the discharge electrodes to the high voltage.

7 Claims, 2 Drawing Sheets

DEVICE FOR NEUTRALIZING ELECTROSTATIC CHARGES

The invention relates to a device for neutralizing electrostatic charges by way of corona discharge comprising a flexible carrier consisting of dielectric material, a row of individual discharge electrodes which are applied to one side of the carrier galvanically separated from one another in the form of thin, electrically conductive layers, and a thin, axially continuous, electrically conductive coating which is arranged on the other side of the carrier opposite to the discharge electrodes, is connected to an alternating high-voltage source and via which the discharge electrodes are capacitively coupled to this voltage source.

A device of this type is known from DE-OS 21 44 948. In the known device, the carrier consists of a material relatively resistant to bending and has no counterelectrode. In addition, the layer construction of the known device is not brought into the final shape by folding of the carrier.

In a further, known device of a different type (U.S. Pat No. 2,866,923), the discharge electrodes consist of tips which are coupled capacitively to a high-voltage cable via helical wire filaments. This type of capacitive coupling requires considerable production resources and leads to a fragmenting of the high voltage applied so that the high voltage occurring at the discharge electrodes cannot be brought to the high value desired per se.

In, again, another known device (DE 31 06 187 A1), strips consisting of flexible, electrically insulating plastic are used as carriers for discharge electrodes, counterelectrode and capacitive coupling coating. However, the discharge electrodes are, individually, not galvanically separated from one another, and the plastic strip is not brought into the final shape of the device by bending or folding. This applies accordingly for a further, known device (DE 29 30 902 A1), in which flat cables insulated in a channel are arranged on both sides of pointed discharge electrodes.

The object of the invention is to improve a generic device such that it can be produced in relatively simple working steps.

The object is accomplished by the invention in a generic device in that the carrier is a flexible plastic film, to which the discharge electrodes, the conductive coating and a counterelectrode are applied in a thin layer, and the layer construction can be formed by bending or folding in axial direction such that the plastic film, the discharge electrodes, the conductive coating and the counterelectrode can be brought into their final, mutual relative positions.

The following description of preferred embodiments of the invention serves to explain this in greater detail in conjunction with the attached drawings. In the drawings.

Figure 1:
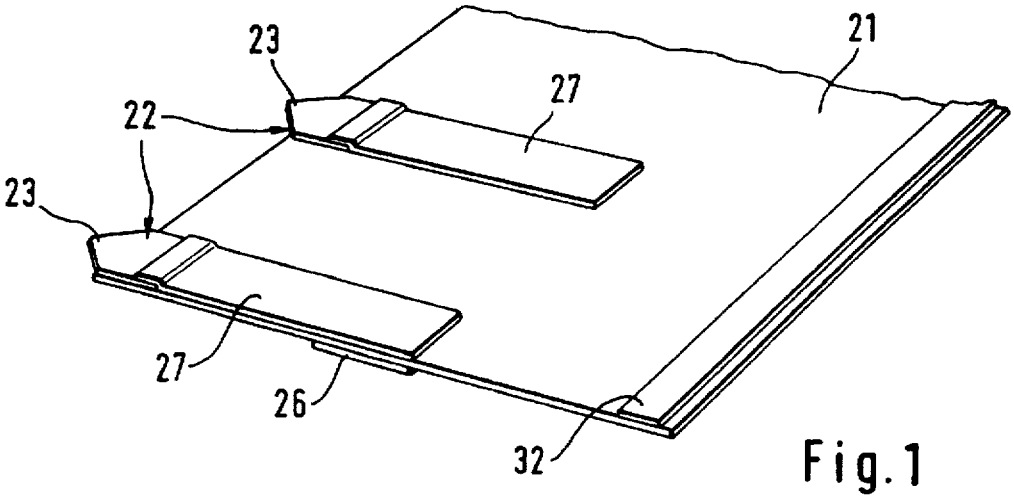
FIG. 1 shows schematically a first embodiment of a device for neutralizing electrostatic charges.
Figure 2:
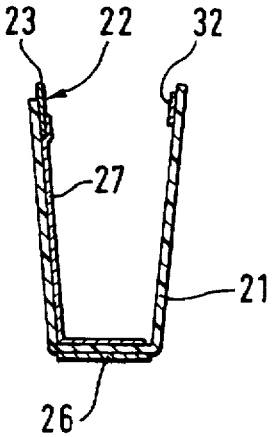
FIG. 2 shows the device from FIG. 1 with edge regions bent upwards.
Figure 3:
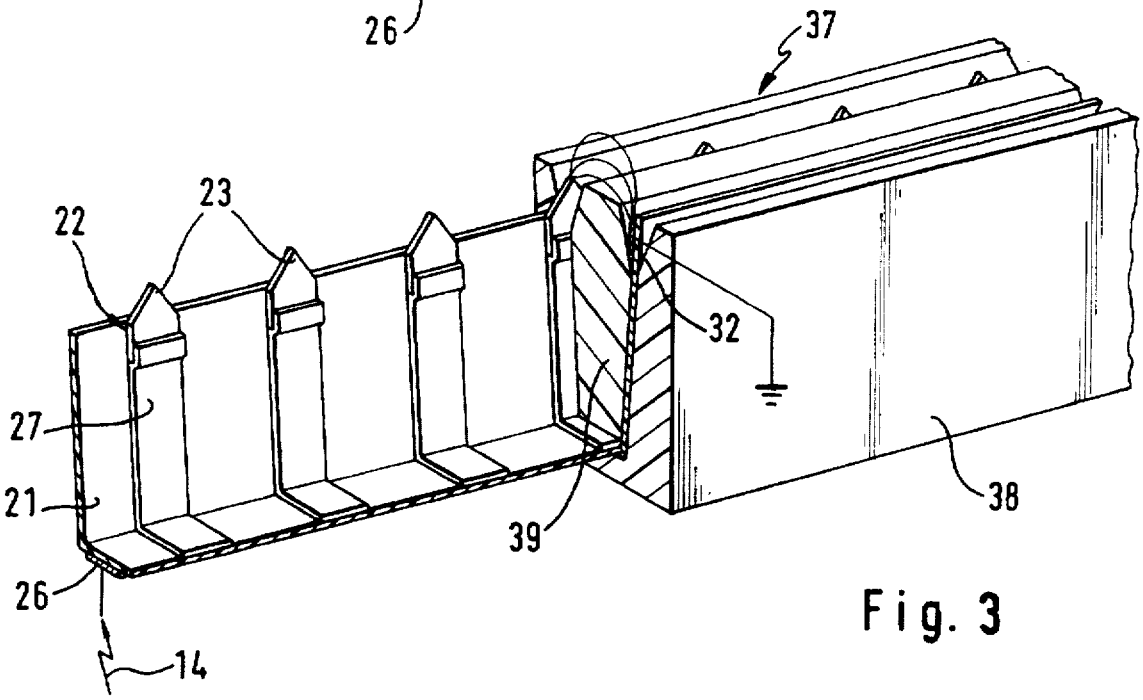
FIG. 3 shows the arrangement of the device from FIG. 2 in a de-electrification bar.

A first embodiment of a device for neutralizing electrostatic charges is illustrated in FIGS. 1 to 3. Individual tips 23 consisting of a thin, electrically conductive material are applied to a flexible, foldable carrier 21 consisting of dielectric material, for example a flexible plastic strip, at a longitudinal edge as discharge electrodes 22, the tips being galvanically separated from one another. These tips 23 can, for example, be designed such that, first of all, the relevant edge of the carrier 21 is provided with a continuous, thin, electrically conductive layer, e.g. consisting of a thin, laminated copper, and the tips 23 are punched or etched out of this copper coating. A flexible, areal, continuous, electrically conductive coating 26 is applied to the opposite side of the carrier 21 approximately in its center, e.g. by vapor deposition or lamination of metal, in particular copper. Proceeding from the tips 23 and connected with them in an electrically conductive manner, areal connecting strips 27 consisting of a flexible, electrically conductive material extend on the side of the carrier 21 opposite the coating 26 as far as a region above this coating 26 and these connecting strips can, for example, likewise be laminated, pressed or sprayed on. The individual tips 23 and connecting strips 27 are galvanically separated from one another.

The regions of the connecting strips 27 respectively located over the continuous coating 26 form a capacitor together with the coating 26 on account of the electrically insulating material of the carrier 21 located therebetween so that the tips 23 of the discharge electrodes 22 are capacitively connected to the coating 26 in this way and accept the voltage of an alternating high-voltage source connected to the coating 26.

Finally, a flexible, electrically conductive counterelectrode 32 is arranged on the carrier 21 likewise continuously in longitudinal direction and parallel to the coating 26 but on the opposite side of the carrier 21. This counterelectrode likewise consists, for example, of laminated metal film which can be earthed.

As is apparent from FIG. 2, the edge regions of the carrier 21 located respectively to the left and to the right of the coating 26 are folded or bent upwards at an angle with the upper parts of the connecting strips 27 and the tips 23 so that a channel-like structure results which, as shown in FIG. 3, is inserted into a preferably rigid de-electrification bar 37. The bar 37 consists of electrically insulating material and comprises an outer channel 38, into which a core portion 39, likewise consisting of electrically insulating material, is inserted with the channel-like structure from FIG. 2 located therebetween so that a stable de-electrification bar 37 results, for example due to additional adhesion. As is apparent from FIG. 3, not only the tips 23 of the discharge electrodes 22 but also the counterelectrode 32 are located in the channel of the bar 37 and are thereby protected to a great extent from any contact. The continuous coating 26 is connected to a high-voltage source 14, the counterelectrode 32 is earthed. The discharge electrodes 22 and the counterelectrode 32 are brought into their favorable position relative to one another as a result of the construction of the channel-like structure of FIG. 2 which is folded or bent upwards.

The embodiment according to FIG. 3 has the advantage that the counterelectrode 32 is already secured on the carrier 21 and thus no separate counterelectrodes need be attached to the de-electrification bar 37, which is a considerable manufacturing advantage. Instead of folding the arms, which are located to the left and the right in FIG. 2 and bear the discharge electrodes 22 and the counterelectrode 32, respectively, more or less at right angles upwards, the structure according to FIG. 2 could also have a channel shape bent more or less in a circle and be inserted into an outer channel 38 of a correspondingly circular shape and having a corresponding core portion 39.

Figure 4:
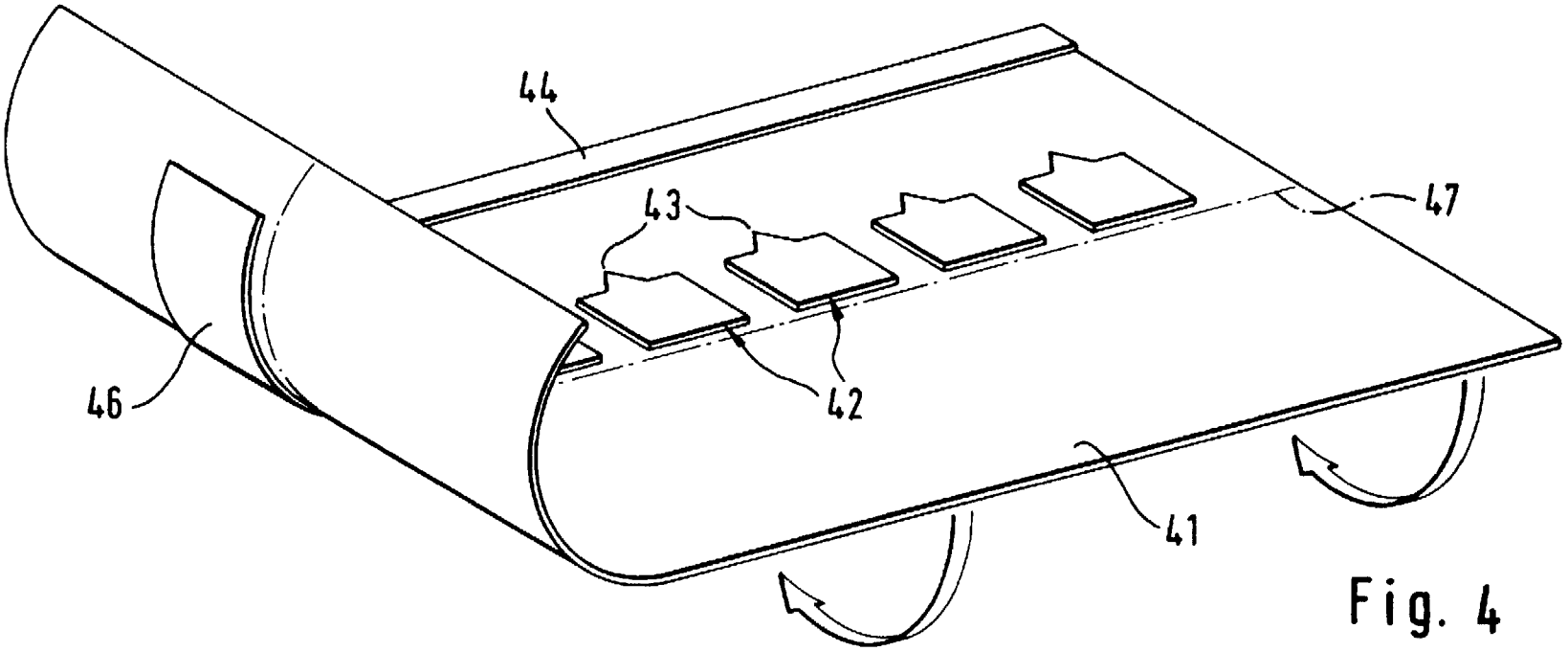
FIG. 4 shows a second embodiment of a device for neutralizing electrostatic charges and FIG. 5 shows the use of the device from FIG. 4 for the de-electrification of an object.
Figure 5:
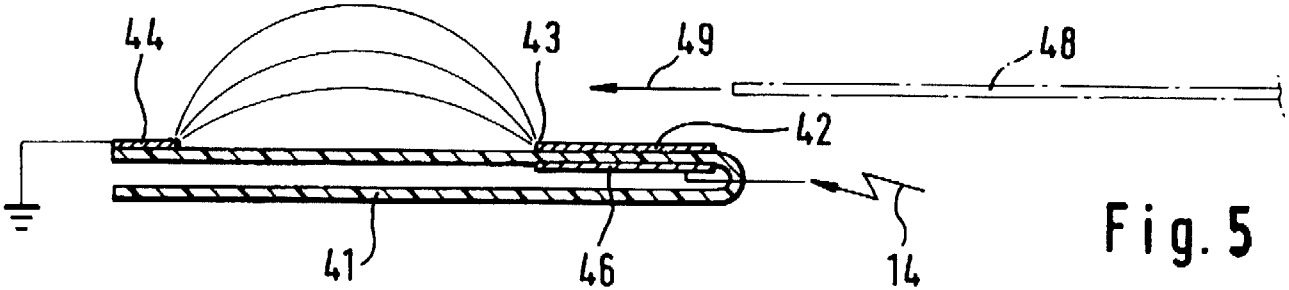

In the second embodiment illustrated in FIGS. 4 and 5, individual discharge electrodes 42 with tips 43, e.g. in the shape of small plates punched out of metal film, are applied to one side of an electrically insulating, flexible and foldable carrier 41 consisting, for example, of a flexible plastic film.

An electrically conductive counterelectrode 44 is securely arranged on the same side of the carrier 41 at its edge, opposite the tips 43. The carrier 41 is again provided on its opposite side with a continuous, electrically conductive coating 46 which is located opposite the areal discharge electrodes 42. The carrier illustrated in FIG. 4 and comprising discharge electrodes 42, counterelectrode 44 and coating 46 is folded or bent through 180° about an axially extending folding line 47 so that the configuration illustrated in FIG. 5 results. The continuous coating 46 is covered and protected by the edge region of the carrier 41 which has been folded down. On the upper side of the arrangement, the discharge electrodes 42 are located to the right in FIG. 5 and the counterelectrode 44 to the left. The continuous coating 46 arranged beneath the discharge electrodes 42 is connected to a high-voltage source 14, the counterelectrode 44 is earthed. A corona discharge field is formed between the tips 43 of the discharge electrodes 42 and the counterelectrode 44. When an object 48, for example a sheet of paper or a textile web, is advanced accordingly in the direction of the arrow 49 over the discharge electrodes 42 and the counterelectrode 44, its electrostatic charges are neutralized.

The arrangement illustrated in FIG. 5 can, as such, be a flexible structure but it could also be reinforced by a rigid carrier, similar to the de-electrification bar 37 in FIG. 3. The object 48 to be de-electrified can be moved forward over the discharge electrodes 42 and the counterelectrode 44 without contact or also be in direct touching contact therewith. In the embodiment according to FIGS. 4 and 5, as well, the final shape of the device is obviously not reached until the carrier 41 is folded or bent, the folded part of the carrier 41 in this case covering the coating 46.

The devices for neutralizing electrostatic charges as described all have the advantage that they can be produced relatively simply. In addition, it is possible, since no capacitive voltage fragmentations occur as in other known de-electrification bars, to have stronger high voltages operative at the tips or edges of the discharge electrodes.

The discharge electrodes 22, 42, the counterelectrodes 32, 44 and/or the electrically conductive coatings 26, 46 preferably consist of metal, for example copper, which can be laminated on, vapor-deposited, sprayed on, pressed on, adhered in the form of films and applied in any other way. Instead of solid, electrically conductive metal layers, other, electrically conductive layers are also suitable, e.g. consisting of conductive plastic. It is favorable to provide the tips or operative ends of the discharge electrodes 22, 42 by way of punching out because sharp-edged cutting edges thereby result which are particularly favorable for the formation of a corona discharge.

Long, thin, flexible, foldable strips consisting of plastic, e.g. polyester, polyimide with as high a dielectric constant as possible and high dielectric strength, are suitable as carrier.

The connection of a high-voltage source 14 to the continuous coating 26, 46 can take place directly by soldering on a high-voltage conductor.

To prevent spark-overs and tracking currents from a tip of one discharge electrode to the tip of the adjacent discharge electrode, the neighboring regions of the tips 23, 43 and the discharge electrodes 22, 42 can be coated with an electrically insulating lacquer. This lacquer replaces the casting resin which is required in the case of conventional de-electrification bars and is thus likewise omitted in the case of the neutralization devices suggested here. This also represents a simplification of the device.

In the case of the embodiments according to FIGS. 1 to 3, the tips 23 of the discharge electrodes 22 can also be flush with the edge of the carrier 21 instead of projecting beyond this edge.

What is claimed is:

1. Device for neutralizing electrostatic charges by way of corona discharge comprising a flexible carrier consisting of dielectric material, a row of individual discharge electrodes applied to one side of the carrier galvanically separated from one another in the form of thin, electrically conductive layers, and a thin, axially continuous, electrically conductive coating arranged on the other side of the carrier opposite to the discharge electrodes, said coating being connected to an alternating high-voltage source and the discharge electrodes being coupled capacitively to this voltage source via said coating, wherein the carrier is a flexible plastic film, the discharge electrodes, the conductive coating and a counterelectrode being applied to said film in a thin layer, and the layer construction is formable by bending or folding in axial direction such that the plastic film, the discharge electrodes, the conductive coating and the counterelectrode are adapted to be brought into their final relative positions.

2. Device as defined in claim 1, wherein the discharge electrodes, the counterelectrode and/or the electrically conductive coating consist of metal and are laminated to the plastic film.

3. Device as defined in claim 1, wherein the discharge electrodes, the counterelectrode and/or the electrically conductive coating are etched out of a flat metal lamination.

4. Device as defined in claim 1, wherein the discharge electrodes, the counterelectrode and/or the electrically conductive coating are pressed or sprayed onto the plastic film.

5. Device as defined in claim 1, wherein tips or cutting edges are formed on the discharge electrodes by punching.

6. Device as defined in claim 1, wherein the neighboring regions of the discharge electrodes are coated with an electrically insulating lacquer.

7. Device as defined in claim 1, wherein the layer construction formed by bending or folding is inserted into a de-electrification bar.

* * * * *